US010087772B2

(12) United States Patent
Sun et al.

(10) Patent No.: US 10,087,772 B2
(45) Date of Patent: Oct. 2, 2018

(54) METHOD AND APPARATUS FOR ACTIVE CLEARANCE CONTROL FOR HIGH PRESSURE COMPRESSORS USING FAN/BOOSTER EXHAUST AIR

(71) Applicant: General Electric Company, Schenectady, NY (US)

(72) Inventors: Changjie Sun, Clifton Park, NY (US); Yu Xie Mukherjee, West Chester, OH (US); Bhaskar Nanda Mondal, Karnataka (IN); Atanu Saha, Karnataka (IN); Marcia Boyle Johnson, Lebanon, OH (US); Wenfeng Lu, Mason, OH (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 233 days.

(21) Appl. No.: 14/977,098

(22) Filed: Dec. 21, 2015

(65) Prior Publication Data

US 2017/0175769 A1 Jun. 22, 2017

(51) Int. Cl.
*F01D 11/24* (2006.01)
*F04D 29/58* (2006.01)
(Continued)

(52) U.S. Cl.
CPC ..... *F01D 11/24* (2013.01); *F04D 29/164* (2013.01); *F04D 29/526* (2013.01); *F04D 29/584* (2013.01)

(58) Field of Classification Search
CPC ..... F01D 11/14; F01D 11/20; F01D 11/24; F04D 29/584; F04D 29/164; F04D 29/526
See application file for complete search history.

(56) References Cited

U.S. PATENT DOCUMENTS 4,513,567 A 4/1985 Deveau et al.
5,100,291 A * 3/1992 Glover ..... F01D 11/24 165/169
(Continued)

OTHER PUBLICATIONS

Lattime, S. et al., "Turbine engine clearance control systems: current practices and future directions," AIAA2002-3790, NASA TM-2002-211794, 38th AIAA/ASME/ASEE Joint Propulsion Conference and Exhibit, Jul. 7-10, 2002.
(Continued)

*Primary Examiner* — Richard Edgar
(74) *Attorney, Agent, or Firm* — GE Global Patent Operation; Nittin Joshi

(57) ABSTRACT

The turbomachine includes a rotatable member defining an axis of rotation and an inner annular casing extending circumferentially over at least a portion of the rotatable member. The inner annular casing includes a radially outer surface. The turbomachine further includes an outer annular casing extending over at least a portion of the inner annular casing. The inner annular casing and the outer annular casing define a plurality of cavities therebetween. The clearance control system includes a manifold system including a plurality of conduits extending circumferentially about the inner annular casing and disposed within the cavities. The clearance control system also includes an impingement system extending circumferentially about the inner annular casing and disposed within the cavities. The conduits are configured to channel a flow of cooling fluid to the impingement system which is configured to channel the cooling fluid to the radially outer surface of the inner annular casing.

21 Claims, 4 Drawing Sheets

(51) Int. Cl.
*F04D 29/52* (2006.01)
*F04D 29/16* (2006.01)

(56) References Cited

U.S. PATENT DOCUMENTS

| | | | | |
|---|---|---|---|---|
| 5,205,115 | A * | 4/1993 | Plemmons | F01D 11/24 415/115 |
| 5,314,303 | A | 5/1994 | Charbonnel et al. | |
| 7,597,537 | B2 * | 10/2009 | Bucaro | F01D 11/24 415/136 |
| 7,819,626 | B2 | 10/2010 | Lee et al. | |
| 8,092,146 | B2 | 1/2012 | Legare et al. | |
| 8,434,997 | B2 | 5/2013 | Pinero et al. | |
| 8,550,767 | B2 | 10/2013 | Horn et al. | |
| 9,157,331 | B2 * | 10/2015 | Laurello | F01D 11/24 |
| 2007/0086887 | A1 | 4/2007 | Pezzetti, Jr. et al. | |
| 2008/0112798 | A1 | 5/2008 | Seitzer et al. | |
| 2014/0241854 | A1 | 8/2014 | Gekht et al. | |
| 2014/0271113 | A1 | 9/2014 | Khalid et al. | |

OTHER PUBLICATIONS

Bae et al.,"Contral of Tip Clearance Flows in Axial Compressors", AIAA 2000-2233, Fluids 2000 Conference & Exhibit, Denver, Colorado, pp. 1-11, Jun. 19-22, 2000.

Lord et al., "Flow Control Opportunities in Gas Turbine Engines", AIAA 2000-2234, pp. 1-15, Jun. 19-22, 2000.

Spakovszky et al., "Tip Clearance Actuation With Magnetic Bearings for High-Speed Compressor Stall Control", Journal of Turbomachinery, ASME 2001:International Gas Turbine Institute and presented at the 45th Internataional Gas Turbine and Aeroengine Congress and Exhibition, vol. No. 123, pp. 464-472, Jul. 2001.

Decastro et al., "A Study on the Requirements for Fast Active Turbine Tip Clearance Control Systems", AIAA-2004-4176, 40th AIAA/ASME/SAE/ASEE Joint Propulsion Conference, Fort Lauderdale, Florida, pp. 23, Jul. 11-14, 2004.

Decastro et al., "System-Level Design of a Shape Memory Alloy Actuator for Active Clearance Control in the High-Pressure Turbine", AIAA-2005-3988, 41st AIAA/ASME/SAE/ASEE Joint Propulsion Conference, Tucson, Arizona, pp. 20, Jul. 10-13, 2005.

Harlin, "Whole Engine Development", VIVACE, VIVACE Forum 1, pp. 1-15, Sep. 20-21, 2005.

Ruiz et al., "Benefits of improved HP turbine active clearance control", 2006 NASA Seal/Secondary Air System Workshop, vol. No. 1, pp. 109-123, Oct. 10, 2006.

Taylor et al., "Further Characterization of an Active Clearance Control Concept", AIAA-2007-5739, 43rd AIAA/ASME/SAE/ASEE Joint Propulsion Conference & Exhibit, Cincinnati, Ohio, pp. 1-17, Jul. 8-11, 2007.

Benito et al., "3D Thermo-Mechanical modelling method to predict compressor local tip running clearances", Proceedings of ASME Turbo Expo 2008: Power for Land, Sea and Air, Heat Transfer, Parts A and B, vol. No. 4, pp. 1-10, Jun. 9-13, 2008.

Atkins, "Passive Tip Clearance Control", European Workshop on New Aero Engine Concepts, Jun. 30-Jul. 1, 2010.

Baker, "Intercooled Engine and Integration", European Workshop on New Aero Engine Concepts, pp. 1-19, Jun. 30-Jul. 1, 2010.

"Development of Advanced Actuation concepts to provide a step change in technology used in future aero-engine control systems", ADVACT Aerospace, AST3-CT-2004-502844, Final Publishable Report, pp. 1-21, Jun. 2010.

* cited by examiner

METHOD AND APPARATUS FOR ACTIVE CLEARANCE CONTROL FOR HIGH PRESSURE COMPRESSORS USING FAN/BOOSTER EXHAUST AIR

BACKGROUND

The field of the disclosure relates generally to systems and methods for active clearance control in aviation engines and, more particularly, to a system and method for active clearance control for high pressure compressors using fan exhaust air.

Aircraft engines generate heat in high pressure compressors. High pressure compressors included disks, compressor blades, and compressor casings. Thermal expansion of disks, compressor blades, and compressor casings change the clearance between the compressor blades and the inner compressor casing. Engine inefficiencies occur when the clearance between the compressor blades and the inner compressor casing is too large, thereby facilitating decreased compressor pressure rise capability and decreased stability. Active clearance control maintains the clearance between the compressor blades and the inner compressor casing. At least some of the known methods for controlling the clearance between the compressor blades and the inner compressor casing are active thermal control and active mechanical control. For example, some known active thermal control methods use compressor bleed air and fan exhaust air to cool the inner compressor casing. Compressor bleed air and fan exhaust air are directed to the outer radial surface of the inner compressor case. The compressor bleed air and fan exhaust air cool the inner compressor casing. The active thermal control method has a slow thermal response.

In addition, some known active mechanical control methods use linkages and actuation to control the clearance between the compressor blades and the inner compressor casing. Segmented shrouds attached to a unison ring and actuators individually control the positioning of each shroud. The active mechanical control method has a quick response rate, but the additional equipment required for the active mechanical control method adds weight to the aircraft.

BRIEF DESCRIPTION

In one aspect, a clearance control system for a turbomachine is provided. The turbomachine includes a rotatable member defining an axis of rotation. The turbomachine also includes an inner annular casing extending circumferentially over at least a portion of the rotatable member. The inner annular casing includes a radially outer surface. The turbomachine further includes an outer annular casing extending over at least a portion of the inner annular casing. The inner annular casing and the outer annular casing define a plurality of cavities therebetween. The clearance control system includes a manifold system including a plurality of conduits disposed within the plurality of cavities. The plurality of conduits extends circumferentially about the inner annular casing. The clearance control system also includes an impingement system disposed within the plurality of cavities. The impingement system extends circumferentially about the inner annular casing. The plurality of conduits is configured to channel a flow of cooling fluid to the impingement system. The impingement system is configured to channel the flow of cooling fluid to the radially outer surface of the inner annular casing.

In another aspect, a method of controlling a clearance between a plurality of compressor blades and an inner annular casing is provided. The method includes defining a plurality of cavities between the inner annular casing and an annular outer casing. The method also includes channeling a plurality of flows of cooling fluid from a cooling fluid source to a manifold system including a plurality of conduits disposed within the plurality of cavities. The method further includes channeling the plurality of flows of cooling fluid from the manifold system to an impingement system disposed within the plurality of cavities and positioned on a radially outer surface of the inner annular casing.

In yet another aspect, a turbomachine is provided. The turbomachine includes a compressor defining an axis of rotation. The compressor includes an inner annular casing including a radially outer surface. The compressor also includes an outer annular casing extending over at least a portion of the inner annular casing. The inner annular casing and the outer annular casing define a plurality of cavities therebetween. The turbomachine also includes a clearance control system. The clearance control system includes a manifold system comprising a plurality of conduits disposed within the plurality of cavities. The plurality of conduits extends circumferentially about the inner annular casing. The clearance control system also includes an impingement system disposed within the plurality of cavities. The impingement system extends circumferentially about the inner annular casing. The plurality of conduits is configured to channel a flow of cooling fluid to the impingement system. The impingement system is configured to channel the flow of cooling fluid to the radially outer surface of the inner annular casing.

DRAWINGS

These and other features, aspects, and advantages of the present disclosure will become better understood when the following detailed description is read with reference to the accompanying drawings in which like characters represent like parts throughout the drawings, wherein.

Figure 1:
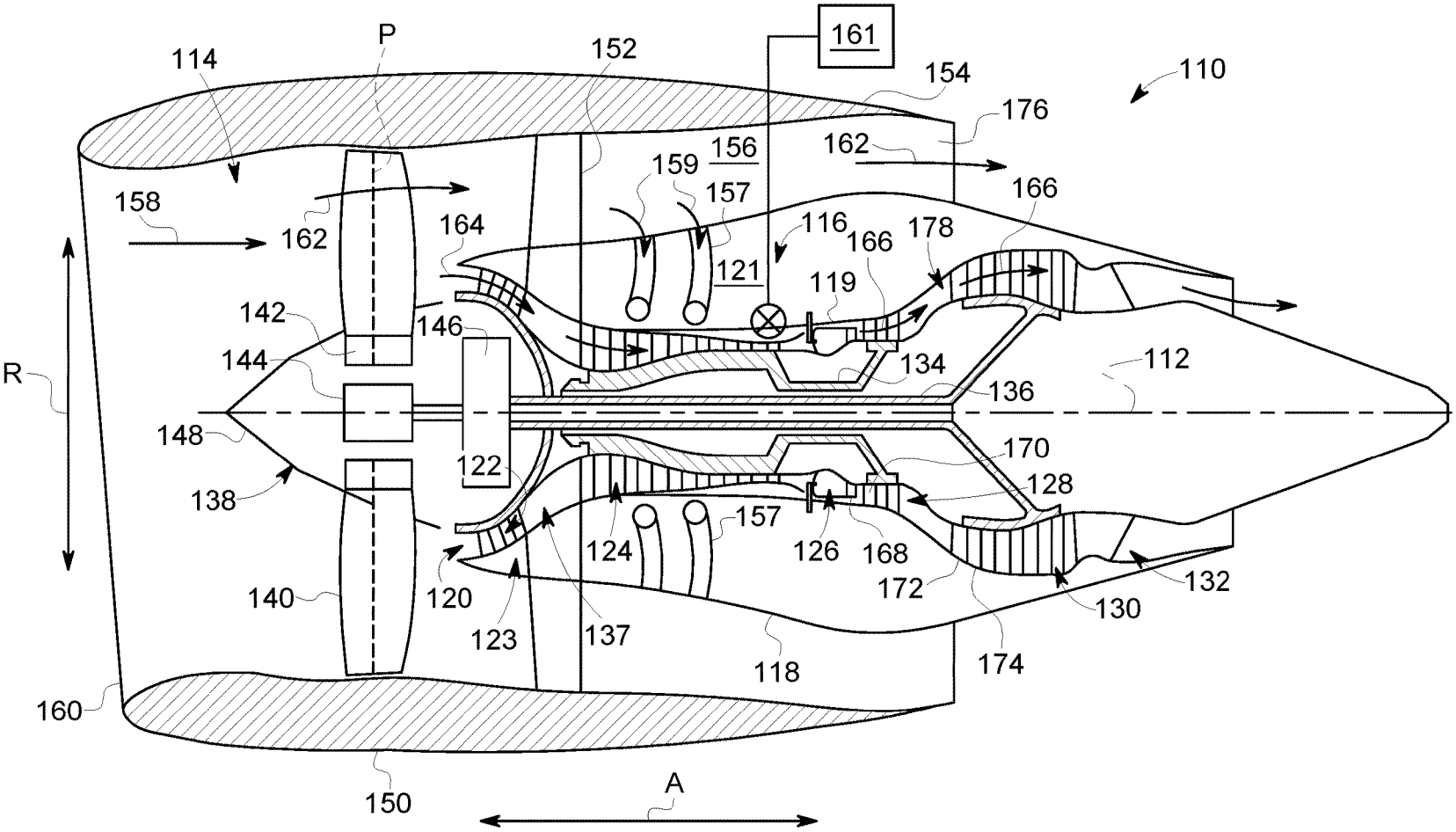
FIG. 1 is a schematic view of a gas turbine engine.

Unless otherwise indicated, the drawings provided herein are meant to illustrate features of embodiments of the disclosure. These features are believed to be applicable in a wide variety of systems comprising one or more embodiments of the disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

As used herein, the terms "processor" and "computer", and related terms, e.g., "processing device", "computing device", and "controller" are not limited to just those integrated circuits referred to in the art as a computer, but broadly refers to a microcontroller, a microcomputer, a programmable logic controller (PLC), an application specific integrated circuit, and other programmable circuits, and these terms are used interchangeably herein. In the embodiments described herein, memory may include, but is not limited to, a computer-readable medium, such as a random access memory (RAM), and a computer-readable non-volatile medium, such as flash memory. Alternatively, a floppy disk, a compact disc-read only memory (CD-ROM), a magneto-optical disk (MOD), and/or a digital versatile disc (DVD) may also be used. Also, in the embodiments described herein, additional input channels may be, but are not limited to, computer peripherals associated with an operator interface such as a mouse and a keyboard. Alternatively, other computer peripherals may also be used that may include, for example, but not be limited to, a scanner. Furthermore, in the exemplary embodiment, additional output channels may include, but not be limited to, an operator interface monitor.

As used herein, the term "non-transitory computer-readable media" is intended to be representative of any tangible computer-based device implemented in any method or technology for short-term and long-term storage of information, such as, computer-readable instructions, data structures, program modules and sub-modules, or other data in any device. Therefore, the methods described herein may be encoded as executable instructions embodied in a tangible, non-transitory, computer readable medium, including, without limitation, a storage device and/or a memory device. Such instructions, when executed by a processor, cause the processor to perform at least a portion of the methods described herein. Moreover, as used herein, the term "non-transitory computer-readable media" includes all tangible, computer-readable media, including, without limitation, non-transitory computer storage devices, including, without limitation, volatile and nonvolatile media, and removable and non-removable media such as a firmware, physical and virtual storage, CD-ROMs, DVDs, and any other digital source such as a network or the Internet, as well as yet to be developed digital means, with the sole exception being a transitory, propagating signal.

Embodiments of the active clearance control system described herein control the clearance between the inner annual casing of a high pressure compressor in a turbomachine, e.g. an aircraft engine, and high pressure compressor blades. The active clearance control system includes an air inlet, a manifold system, a controller, and an impingement system. The air inlet directs fan air from the bypass airflow passage to the manifold system. The manifold system directs air to the impingement system through a distribution manifold and a plurality of supply tube. An air valve and a controller control the volume of air directed to the impingement system. The supply tubes direct air to a plurality of plenums in the impingement system. The plenums cool the inner annular casing of the high pressure compressor by directing air to the radially outer surface of the inner annular casing. Cooling the inner annular casing of the high pressure compressor reduces thermal expansion of the casing and decreases the clearance between the inner annual casing of a high pressure compressor in an aircraft engine and high pressure compressor blades.

The active clearance control system described herein offers advantages over known methods of controlling clearances in aircraft engines. More specifically, the active clearance control system described herein facilitates using fan exhaust air, rather than a mixture of compressor bleed air and fan exhaust air, as the sole cooling fluid on the compressor casing. Fan exhaust air is typically substantially cooler than compressor bleed air. Using fan exhaust air as the sole cooling fluid facilitates a quicker thermal response and faster clearance control. Furthermore, the active clearance control system described herein reduces the weight of the aircraft by reducing the number of mechanical parts for controlling the clearance between the inner annual casing of a high pressure compressor in an aircraft engine and high pressure compressor blades.

FIG. 1 is a schematic cross-sectional view of a gas turbine engine 110 in accordance with an exemplary embodiment of the present disclosure. In the exemplary embodiment, gas turbine engine 110 is a high-bypass turbofan jet engine 110, referred to herein as "turbofan engine 110." As shown in FIG. 1, turbofan engine 110 defines an axial direction A (extending parallel to a longitudinal centerline 112 provided for reference) and a radial direction R. In general, turbofan engine 110 includes a fan section 114 and a core turbine engine 116 disposed downstream from fan section 114.

Exemplary core turbine engine 116 depicted generally includes a substantially tubular outer casing 118 that defines an annular inlet 120. Outer casing 118 and an inner casing 119 encases, in serial flow relationship, a compressor section 123 including a booster or low pressure (LP) compressor 122 and a high pressure (HP) compressor 124; a combustion section 126; a turbine section including a high pressure (HP) turbine 128 and a low pressure (LP) turbine 130; and a jet exhaust nozzle section 132. The volume between outer casing 118 and inner casing 119 forms a plurality of cavities 121. A high pressure (HP) shaft or spool 134 drivingly connects HP turbine 128 to HP compressor 124. A low pressure (LP) shaft or spool 136 drivingly connects LP turbine 130 to LP compressor 122. Compressor section 123, combustion section 126, turbine section, and nozzle section 132 together define a core air flowpath 137.

As shown in FIG. 1, fan section 114 includes a variable pitch fan 138 having a plurality of fan blades 140 coupled to a disk 142 in a spaced apart manner. As depicted, fan blades 140 extend outwardly from disk 142 generally along radial direction R. Each fan blade 140 is rotatable relative to disk 142 about a pitch axis P by virtue of fan blades 140 being operatively coupled to a suitable pitch change mechanism 144 configured to collectively vary the pitch of fan blades 140 in unison. Fan blades 140, disk 142, and pitch change mechanism 144 are together rotatable about longitudinal axis 112 by LP shaft 136 across a power gear box 146. Power gear box 146 includes a plurality of gears for adjusting the rotational speed of fan 138 relative to LP shaft 136 to a more efficient rotational fan speed.

Also, in the exemplary embodiment, disk 142 is covered by rotatable front hub 148 aerodynamically contoured to promote an airflow through plurality of fan blades 140. Additionally, exemplary fan section 114 includes an annular fan casing or outer nacelle 150 that circumferentially surrounds fan 138 and/or at least a portion of core turbine engine 116. Nacelle 150 is configured to be supported relative to core turbine engine 116 by a plurality of circumferentially-spaced outlet guide vanes 152. A downstream section 154 of nacelle 150 extends over an outer portion of core turbine engine 116 so as to define a bypass airflow passage 156 therebetween. A plurality of active clearance control systems 157 are disposed within cavities 121 and circumscribe core turbine engine 116.

During operation of turbofan engine 110, a volume of air 158 enters turbofan engine 110 through an associated inlet 160 of nacelle 150 and/or fan section 114. As volume of air 158 passes across fan blades 140, a first portion of air 158 as indicated by arrows 162 is directed or routed into bypass airflow passage 156 and a second portion of air 158 as indicated by arrow 164 is directed or routed into core air flowpath 137, or more specifically into LP compressor 122. The ratio between first portion of air 162 and second portion of air 164 is commonly known as a bypass ratio. The pressure of second portion of air 164 is then increased as it is routed through HP compressor 124 and into combustion section 126, where it is mixed with fuel and burned to provide combustion gases 166. A portion of first portion of air 162 as indicated by arrows 159 is directed into active clearance control system 157 to cool inner casing 119. In an alternative embodiment, free stream ambient air or nacelle boundary layer air is directed into active clearance control system 157 to cool inner casing 119.

Combustion gases 166 are routed through HP turbine 128 where a portion of thermal and/or kinetic energy from combustion gases 166 is extracted via sequential stages of HP turbine stator vanes 168 that are coupled to outer casing 118 and HP turbine rotor blades 170 that are coupled to HP shaft or spool 134, thus causing HP shaft or spool 134 to rotate, thereby supporting operation of HP compressor 124. Combustion gases 166 are then routed through LP turbine 130 where a second portion of thermal and kinetic energy is extracted from combustion gases 166 via sequential stages of LP turbine stator vanes 172 that are coupled to outer casing 118 and LP turbine rotor blades 174 that are coupled to LP shaft or spool 136, thus causing LP shaft or spool 136 to rotate, thereby supporting operation of LP compressor 122 and/or rotation of fan 138.

Combustion gases 166 are subsequently routed through jet exhaust nozzle section 132 of core turbine engine 116 to provide propulsive thrust. Simultaneously, the pressure of first portion of air 162 is substantially increased as first portion of air 162 is routed through bypass airflow passage 156 before it is exhausted from a fan nozzle exhaust section 176 of turbofan engine 110, also providing propulsive thrust. HP turbine 128, LP turbine 130, and jet exhaust nozzle section 132 at least partially define a hot gas path 178 for routing combustion gases 166 through core turbine engine 116.

Exemplary turbofan engine 110 depicted in FIG. 1 is by way of example only, and that in other embodiments, turbofan engine 110 may have any other suitable configuration. It should also be appreciated, that in still other embodiments, aspects of the present disclosure may be incorporated into any other suitable gas turbine engine. For example, in other embodiments, aspects of the present disclosure may be incorporated into, e.g., a turboprop engine.

Figure 2:
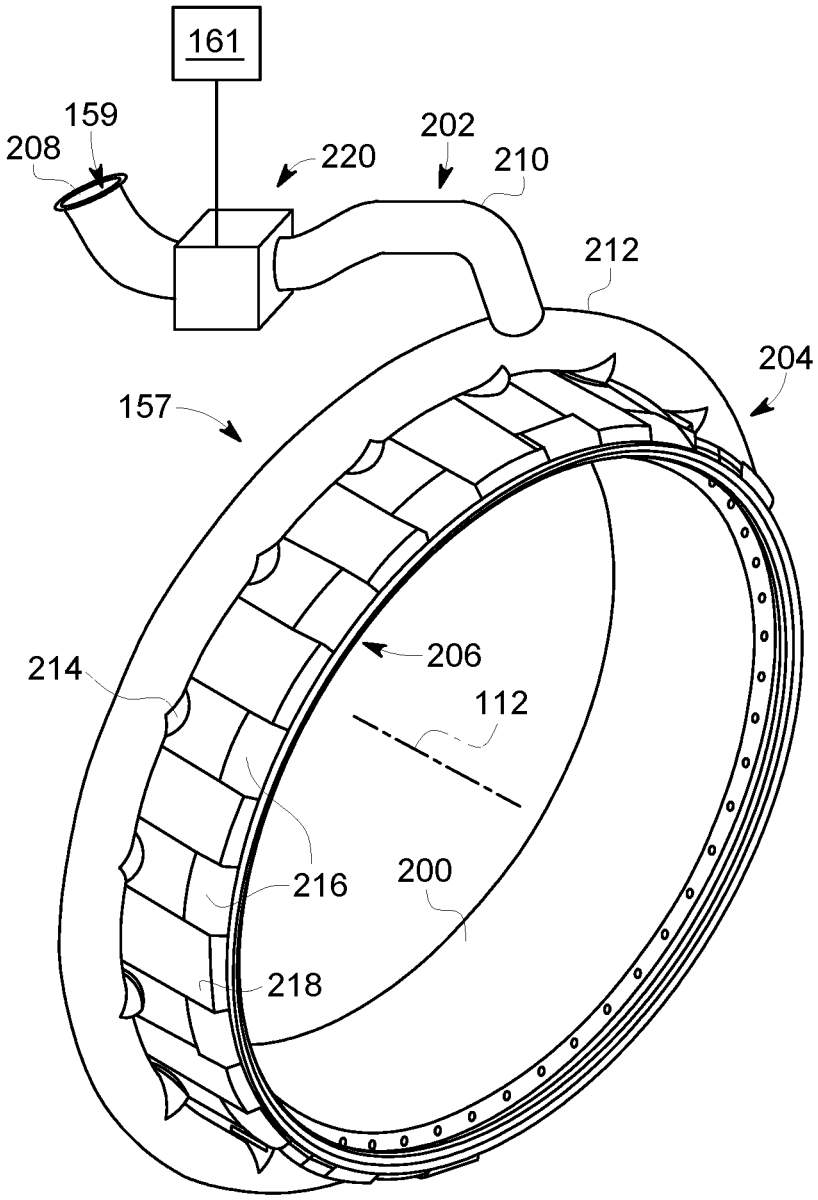
FIG. 2 is a perspective view of the active clearance control system shown in FIG. 1.

FIG. 2 is a perspective view of an inner annual casing 200 and an exemplary active clearance control system 157. Active clearance control system 157 circumscribes inner annual casing 200 which circumscribes HP compressor 124 (shown in FIG. 1). Active clearance control system 157 includes an air intake system 202 coupled in flow communication to a manifold system 204 which is coupled in flow communication to an impingement system 206. Air intake system 202 includes an air supply inlet 208 to an axial air supply tube 210 located downstream of outlet guide vanes 152 (shown in FIG. 1) disposed in bypass airflow passage 156 (shown in FIG. 1) downstream of variable pitch fan 138 (shown in FIG. 1). Manifold system 204 includes a distribution manifold 212 and a plurality of supply tubes 214. Distribution manifold 212 is an annular supply tube circumscribing at least a portion of HP compressor 124. Supply tubes 214 are coupled in flow communication with distribution manifold 212 and impingement system 206. Impingement system 206 includes a plurality of plenums 216 circumferentially spaced apart on a radially outer surface 218 of inner annual casing 200. Plenums 216 are in flow communication with radially outer surface 218 of inner annual casing 200.

During operation of turbofan engine 110 (shown in FIG. 1), portion of air 159 is directed or routed into air supply inlet 208. An air valve 220 disposed in air supply tube 210 controls the volume of portion of air 159. Air valve 220 is controlled by a controller 161. Air flows from air supply tube 210 to distribution manifold 212. Distribution manifold 212 distributes air to supply tubes 214 which distribute air to plenums 216. Plenums 216 distribute air to radially outer surface 218 of inner annual casing 200 which cools radially outer surface 218. Cooling radially outer surface 218 reduces thermal expansion of inner annual casing 200.

Figure 3:
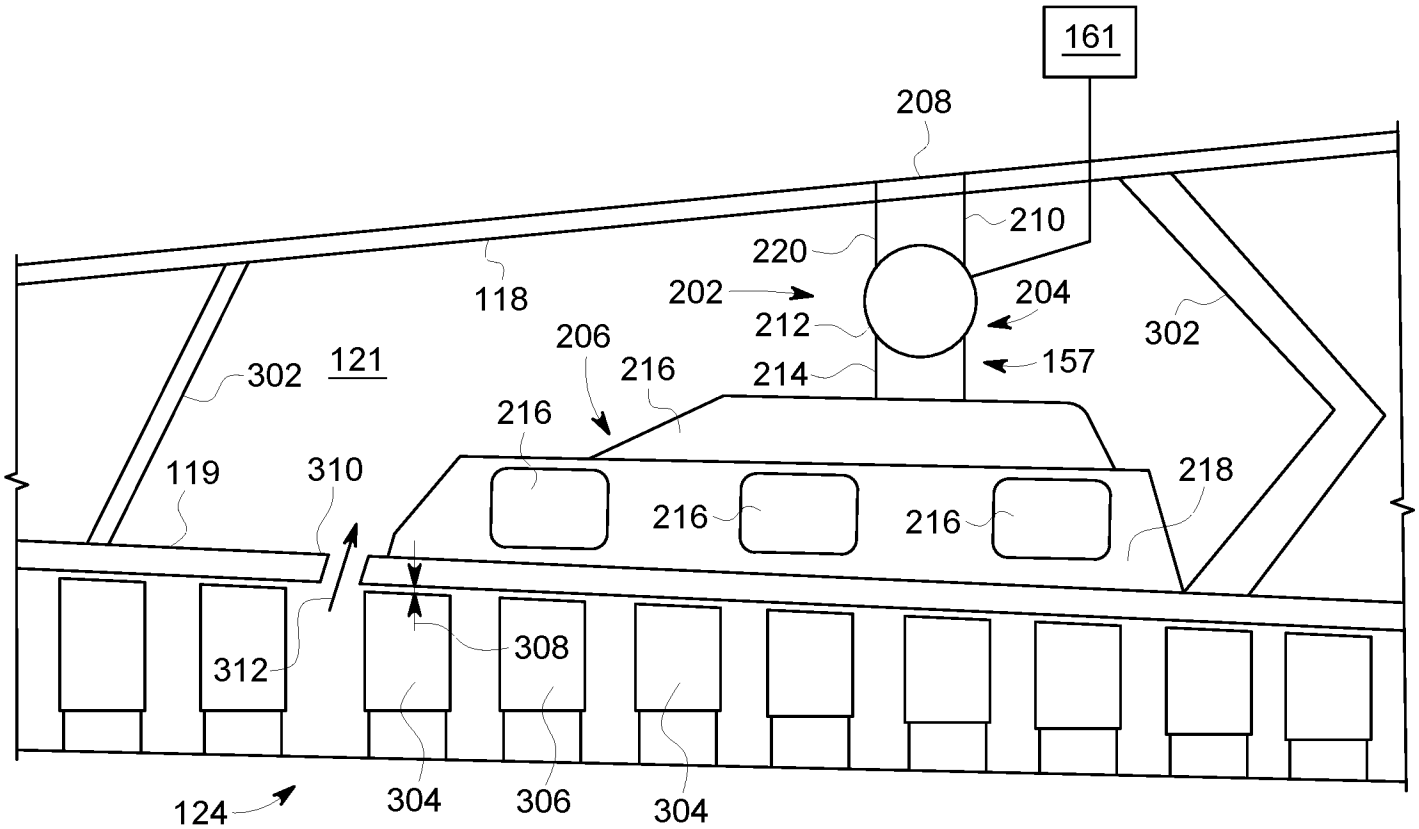
FIG. 3 is a schematic view of the active clearance control system shown in FIGS. 1 and 2 disposed within a cavity in flow communication with a high pressure compressor.

FIG. 3 is a schematic view of exemplary active clearance control system 157. Active clearance control system 157 is disposed within cavities 121 and circumscribes core turbine engine 116. The volume between outer casing 118, inner casing 119, and a plurality of walls 302 forms cavity 121. HP compressor 124 includes HP compressor blades 304 and a plurality of HP compressor vanes 306. Clearance 308 is the distance between HP compressor blades 304 and inner annual casing 119. A bleed slot 310 couples HP compressor 124 in flow communication with cavity 121.

During operation of turbofan engine 110 (shown in FIG. 1), portion of air 159 (shown in FIG. 1) is directed or routed into air supply inlet 208 and air supply tube 210. Air flows from air supply tube 210 flows to distribution manifold 212. Air valve 220 disposed in air supply tube 210 controls the volume of portion of air 159. Air valve 220 is controlled by a controller 161. Distribution manifold 212 distributes air to supply tubes 214 which distribute air to plenums 216. Plenums distribute air to and cool radially outer surface 218 of inner annual casing 119. Cooling radially outer surface 218 of inner annual casing 119 reduces thermal expansion of inner annual casing 119 and reduces clearance 308. A volume of compressor bleed air 312 as indicated by arrow 312 flows through bleed slot 310 into cavity 121. Compressor bleed air 312 has a higher temperature than the air in active clearance control system 157. Heat transfer from compressor bleed air 312 to active clearance control system 157 increases the temperature of the air in active clearance control system 157. Increased temperature of portion of air 159 in active clearance control system 157 decreases cooling of radially outer surface 218 of inner annual casing 119 which increases thermal expansion of inner annual casing 119 and increases clearance 308.

Figure 4:
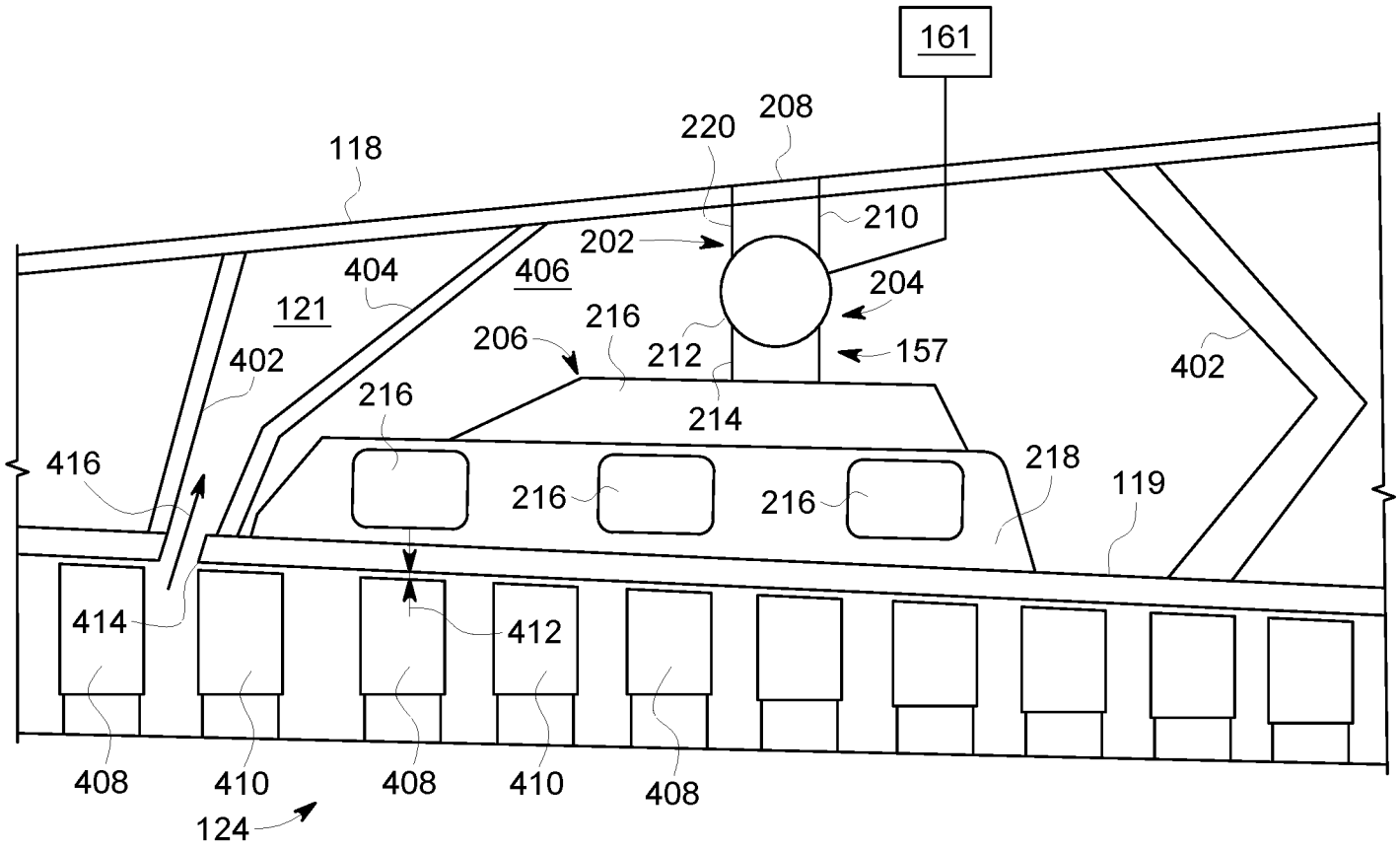
FIG. 4 is a schematic view of the active clearance control system shown in FIGS. 1 and 2 disposed within a cavity isolated from a high pressure compressor.

FIG. 4 is a schematic view of an alternative active clearance control system 157. The volume between outer casing 118, inner casing 119, and a plurality of walls 402 forms cavity 121. Cavity 121 is further divided into two regions including cavity 121 and a thermally isolated cavity 406 by thermal isolation wall 404. Thermal isolation wall 404 includes a thermal insulating material. Active clearance control system 157 is disposed within thermally isolated cavity 406 and circumscribe core turbine engine 116. HP compressor 124 includes HP compressor blades 408 and a plurality of HP compressor vanes 410. A clearance 412 is the distance between HP compressor blades 408 and inner annual casing 119. A bleed slot 414 couples HP compressor 124 in flow communication with cavity 121. Active clearance control system 157 shown in FIG. 3 is substantially similar to active clearance control system 157 shown in FIG. 4 with the difference discussed below. The difference between the embodiment shown in FIG. 4 and the embodiment shown in FIG. 3 is that cavity 121 shown in FIG. 3 is in flow communication with HP compressor 124 and thermally isolated cavity 406 shown in FIG. 4 is not in flow communication with HP compressor 124.

During operation of turbofan engine 110 (shown in FIG. 1), portion of air 159 (shown in FIG. 1) is directed or routed into air supply inlet 208 and air supply tube 210. Air flows from air supply tube 210 flows to distribution manifold 212. Air valve 220 disposed in air supply tube 210 controls the volume of portion of air 159. Air valve 220 is controlled by a controller 161. Distribution manifold 212 distributes air to supply tubes 214 which distribute air to plenums 216. Plenums distribute air to and cool radially outer surface 218 of inner annual casing 119. Cooling radially outer surface 218 of inner annual casing 119 reduces thermal expansion of inner annual casing 119 and reduces clearance 412. A volume of compressor bleed air 416 as indicated by arrow 416 flows through bleed slot 414 into cavity 121. Compressor bleed air 416 has a higher temperature than the air in active clearance control system 157. Thermal isolation wall 404 thermally isolates active clearance control system 157 by preventing high temperature compressor bleed air 416 from contacting active clearance control system 157. Thermal isolation of active clearance control system 157 prevents heat transfer from compressor bleed air 416 to active clearance control system 157 which decreases the temperature of the air in active clearance control system 157. Decreased temperature of portion of air 159 in active clearance control system 157 increases cooling of radially outer surface 218 of inner annual casing 119 which decreases thermal expansion of inner annual casing 119 and decreases clearance 308. The operation of active clearance control system 157 shown in FIG. 3 is substantially similar to the operation of active clearance control system 157 shown in FIG. 4 with the difference discussed below. During operation, compressor bleed air 312 contacts and exchanges heat with active clearance control system 157 shown in FIG. 3. Compressor bleed air 416 does not contact or exchange heat with active clearance control system 157 shown in FIG. 4.

The above-described active clearance control system provides an efficient method for controlling the blade clearance in a turbomachine. Specifically, delivering fan exhaust air directly to the surface of the HP compressor reduces thermal expansion of the HP compressor casing. Additionally, delivering fan exhaust air directly to the surface of the HP compressor rather than using actuators and linkages reduces the weight of the turbomachine. Finally, preventing compressor bleed air from contacting the active clearance control system decreases the temperature of the exhaust fan air contacting the surface of the HP compressor and increases the response rate of the active clearance control system.

An exemplary technical effect of the methods, systems, and apparatus described herein includes at least one of: (a) decreasing the temperature on the inner annular casing of a turbomachine; (b) decreasing the clearance between the HP compressor blades and the inner annular casing of a turbomachine; and (c) decreasing the heat transfer from compressor bleed air to the active clearance control system in the bleed cavities.

Exemplary embodiments of the active clearance control system are described above in detail. The active clearance control system, and methods of operating such units and devices are not limited to the specific embodiments described herein, but rather, components of systems and/or steps of the methods may be utilized independently and separately from other components and/or steps described herein. For example, the methods may also be used in combination with other systems for controlling clearances, and are not limited to practice with only the systems and methods as described herein. Rather, the exemplary embodiment may be implemented and utilized in connection with many other machinery applications that require clearance control.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

Some embodiments involve the use of one or more electronic or computing devices. Such devices typically include a processor, processing device, or controller, such as a general purpose central processing unit (CPU), a graphics processing unit (GPU), a microcontroller, a reduced instruction set computer (RISC) processor, an application specific integrated circuit (ASIC), a programmable logic circuit (PLC), a field programmable gate array (FPGA), a digital signal processing (DSP) device, and/or any other circuit or processing device capable of executing the functions described herein. The methods described herein may be encoded as executable instructions embodied in a computer readable medium, including, without limitation, a storage device and/or a memory device. Such instructions, when executed by a processing device, cause the processing device to perform at least a portion of the methods described herein. The above examples are exemplary only, and thus are not intended to limit in any way the definition and/or meaning of the term processor and processing device.

This written description uses examples to describe the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A clearance control system for a turbomachine, the turbomachine including a rotatable member defining an axis of rotation, an inner annular casing extending directly over at least a portion of the rotatable member along a circumferential direction to define a clearance therebetween, the inner annular casing including a radially outer surface, the turbomachine further including an outer annular casing extending over at least a portion of the inner annular casing, the inner annular casing and the outer annular casing defining at least one cavity therebetween, the clearance control system comprising:

a manifold system comprising a plurality of supply tubes disposed within the at least one cavity, the plurality of supply tubes extending circumferentially about the inner annular casing; and an impingement system disposed within the at least one cavity, the impingement system extending circumferentially about the inner annular casing, the plurality of supply tubes configured to channel a flow of a cooling fluid to the impingement system, the impingement system configured to channel the flow of the cooling fluid directly to the radially outer surface of the inner annular casing, wherein the at least one cavity is coupled in flow communication with the turbomachine.

2. The clearance control system of claim 1, wherein the cooling fluid comprises air.

3. The clearance control system of claim 1, wherein the manifold system comprises an air valve.

4. The clearance control system of claim 3, further comprising a controller configured to control a position of the air valve.

5. The clearance control system of claim 1, wherein the impingement system comprises a plurality of plenums disposed on the radially outer surface of the inner annular casing.

6. A method of controlling a clearance between a plurality of compressor blades and an inner annular casing, the method comprising:

defining at least one cavity between the inner annular casing and an outer annular casing;

channeling a flow of a cooling fluid from a cooling fluid source to a manifold system including a plurality of supply tubes disposed within the at least one cavity; and channeling the flow of the cooling fluid directly from the manifold system to a radially outer surface of the inner annular casing via an impingement system disposed within the at least one cavity and positioned on the radially outer surface of the inner annular casing.

7. The method of claim 6, wherein channeling the flow of the cooling fluid from the cooling fluid source to manifold system comprises channeling air from an air source to manifold system.

8. The method of claim 6, wherein defining the at least one cavity between the inner annular casing and the annular outer casing comprises defining the at least one cavity between the inner annular casing and the annular outer casing in flow communication with a high pressure compressor.

9. The method of claim 6, wherein defining the at least one cavity between the inner annular casing and the annular outer casing comprises defining the at least one cavity between the inner annular casing and the annular outer casing isolated from a high pressure compressor.

10. The method of claim 6, wherein channeling the flow of the cooling fluid from the cooling fluid source to the manifold system including the plurality of supply tubes disposed within the the at least one cavity comprises channeling the flow of the cooling fluid from the cooling fluid source to an air valve disposed within the manifold system.

11. A turbomachine comprising:

a compressor comprising a rotatable member defining an axis of rotation, the compressor comprising:

an inner annular casing comprising a radially outer surface extending directly over at least a portion of the rotatable member along a circumferential direction to define a clearance therebetween; and an outer annular casing extending over at least a portion of the inner annular casing, the inner annular casing and the outer annular casing defining at least one cavity therebetween; and a clearance control system comprising:

a manifold system comprising a plurality of supply tubes disposed within the at least one cavity, the plurality of supply tubes extending circumferentially about the inner annular casing; and an impingement system disposed within the at least one cavity, the impingement system extending circumferentially about the inner annular casing, the plurality of supply tubes configured to channel a flow of a cooling fluid to the impingement system, the impingement system is configured to channel the flow of the cooling fluid directly to the radially outer surface of the inner annular casing.

12. The turbomachine of claim 11, wherein the cooling fluid comprises air.

13. The turbomachine of claim 11, wherein the impingement system comprises a plurality of plenums disposed on the radially outer surface of the inner annular casing.

14. The turbomachine of claim 11 further comprising a plurality of walls disposed within the at least one cavity, wherein the plurality of walls separates the at least one cavity into a first region and a second region, the first region coupled in flow communication with the turbomachine, the plurality of walls is configured to isolate the second region from the first region, the clearance control system disposed within the second region.

15. The turbomachine of claim 14, wherein the plurality of walls comprises a thermal insulating material.

16. The turbomachine of claim 11, wherein the manifold system comprises an air valve.

17. The turbomachine of claim 16 further comprising a controller configured to control a position of the air valve.

18. A clearance control system for a turbomachine, the turbomachine including a rotatable member defining an axis of rotation, an inner annular casing extending directly over at least a portion of the rotatable member along a circumferential direction to define a clearance therebetween, the inner annular casing including a radially outer surface, the turbomachine further including an outer annular casing extending over at least a portion of the inner annular casing, the inner annular casing and the outer annular casing defining at least one cavity therebetween, the clearance control system comprising:

a manifold system comprising a plurality of supply tubes disposed within the at least one cavity, the plurality of supply tubes extending circumferentially about the inner annular casing;

an impingement system disposed within the at least one cavity, the impingement system extending circumferentially about the inner annular casing, the plurality of supply tubes configured to channel a flow of a cooling fluid to the impingement system, the impingement system configured to channel the flow of the cooling fluid directly to the radially outer surface of the inner annular casing; and a plurality of walls disposed within the at least one cavity, wherein the plurality of walls separates the at least one cavity into a first region and a second region, the first region coupled in flow communication with the turbomachine, the plurality of walls is configured to isolate the second region from the first region, the clearance control system disposed within the second region.

19. The clearance control system of claim 18, wherein the plurality of walls comprises a thermal insulating material.

20. The clearance control system of claim 18, wherein the manifold system comprises an air valve.

21. The clearance control system of claim 20, further comprising a controller configured to control a position of the air valve.

* * * * *